United States Patent [19]

Teshima et al.

[11] Patent Number: 4,778,293

[45] Date of Patent: Oct. 18, 1988

[54] DOT MATRIX PRINT HEAD

[75] Inventors: Minoru Teshima; Noboru Oishi; Kenji Sato, all of Tokyo, Japan

[73] Assignee: Oki Electric Industry Co., Ltd., Tokyo, Japan

[21] Appl. No.: 78,755

[22] Filed: Jul. 28, 1987

[30] Foreign Application Priority Data

Aug. 1, 1986 [JP] Japan ..... 61-180079

[51] Int. Cl.[4] ..... B41J 29/00

[52] U.S. Cl. ..... 400/124; 400/719

[58] Field of Search ..... 400/54, 124, 719; 335/217, 300; 101/93.04, 93.05

[56] References Cited

U.S. PATENT DOCUMENTS 4,629,343 12/1986 Bernardis ..... 400/124

FOREIGN PATENT DOCUMENTS 89963 7/1981 Japan ..... 400/124

15168 1/1985 Japan ..... 400/124

*Primary Examiner*—Paul T. Sewell

*Attorney, Agent, or Firm*—Wenderoth, Lind & Ponack

[57] ABSTRACT

A dot matrix print head has a temperature sensor for detecting the temperature of the print head itself. When the detected temperature exceeds a preset temperature, the temperature sensor produces and output signal for stopping or slowing down the dot matrix print head so that its temperature may be lowered. The temperature sensor is accommodated in a substantially central hole of a radial member mounted in a heat conductor body and having a plurality of circumferentially spaced heat conducting arms with their radially outer ends held intimately against the radially inner surfaces of driver or demagnetizing coils which actuate dot pins. The heat conducting arms can quickly and accurately conduct the heat from the coils to the temperature sensor.

2 Claims, 2 Drawing Sheets

FIG. 3

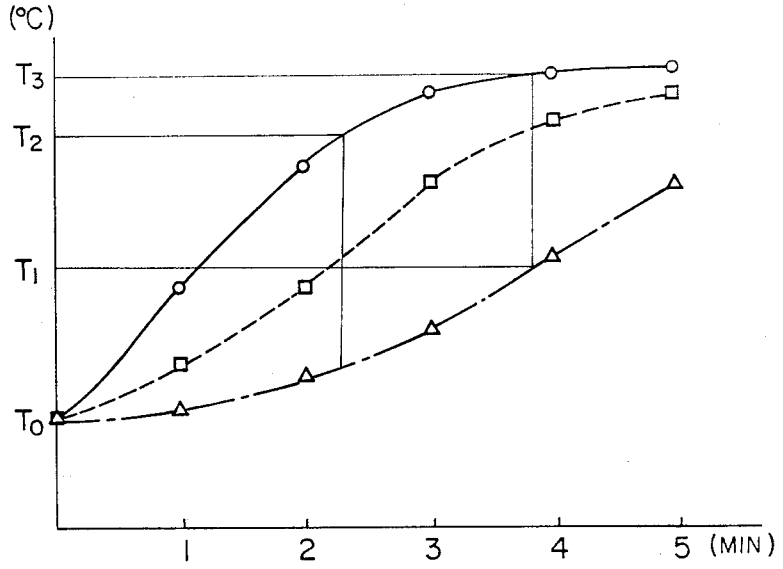

○ CHINESE CHARACTERS 55 CPS TEMPERATURE CURVE OF DRIVER COIL

□ CHINESE CHARACTERS 55 CPS TEMPERATURE CURVE OF THERMISTOR IN INVENTIVE HEAD

△ CHINESE CHARACTERS 55 CPS TEMPERATURE CURVE OF THERMISTOR IN CONVENTIONAL HEAD $T_0$ : INITIAL TEMPERATURE OF PRINT HEAD $T_1$ : DETECTED THERMISTOR TEMPERATURE $T_2$ : DRIVER COIL LIMIT TEMPERATURE $T_3$ : DRIVER COIL TEMPERATURE REACHED WHEN THERMISTOR TEMPERATURE REACHED $T_1$ IN CONVENTIONAL HEAD

DOT MATRIX PRINT HEAD

BACKGROUND OF THE INVENTION

1. Field of the Invention

The present invention relates to a dot matrix print head for use in a dot matrix printer, and more particularly to a dot matrix print head having a temperature sensor for detecting the temperature of the head itself for controlling the printing operation.

2. Description of the Relevant Art

Some dot matrix print heads include a temperature sensor for detecting the temperature of the head itself. When the temperature detected by the temperature sensor exceeds a preset temperature, the dot matrix print head is stopped or slowed down so that its temperature will be lowered. However, known such dot matrix print heads have proven unsatisfactory in that the heat of coils cannot be conducted quickly and accurately to the temperature sensor. As a consequence, the coils may be subjected to burn out before the temperature sensor produces an output signal, or the dot matrix print head may be reduced in service life because of an undue heat buildup therein.

SUMMARY OF THE INVENTION

It is an object of the present invention to provide a dot matrix print head having a temperature sensor for detecting the temperature of the head itself, the dot matrix print head including means for preventing demagnetizing coils from burnout and also preventing the head from being reduced in service life.

According to the present invention, a dot matrix print head includes a plurality of angularly spaced cores combined with a permanent magnet in forming a magnetic path, a plurality of selectively energizable coils disposed respectively around the cores, a plurality of angularly spaced dot pins normally attracted magnetically toward the cores by the permanent magnet and selectively actuatable in response to selective energization of the coils, a heat conductor body supporting the coils, a radial member mounted in the heat conductor body and having a substantially central hole and a plurality of heat conducting arms projecting radially outwardly from the substantially central hole and having radially outer ends held in intimate contact with respective radially inner surfaces of the coils, and temperature sensor accommodated in the substantially central hole of the radial member. The heat conducting arms are angularly spaced at equal intervals in the circumferential direction.

The heat generated by any of the coils can quickly and accurately be conducted through the corresponding heat conducting arms to the temperature sensor. When the temperature of a coil exceeds a preset allowable range, the heat of the coil is immediately conducted to trigger the temperature sensor which then produces an output signal for controlling the dot matrix print head. Thus, the coils are prevented from burnout due to an excessive temperature rise, and hence the service life of the dot matrix print head is prevented from being reduced.

The above and other objects, features and advantages of the present invention will be become more apparent from the following description when taken in conjunction with the accompanying drawings in which a preferred embodiment of the present invention is shown by way of illustrative example.

BRIEF DESCRIPTION OF THE DRAWINGS

FIG. 3 is a graph showing temperature curves of a driver coil and thermistors.

DESCRIPTION OF THE PREFERRED EMBODIMENT

Figure 1:
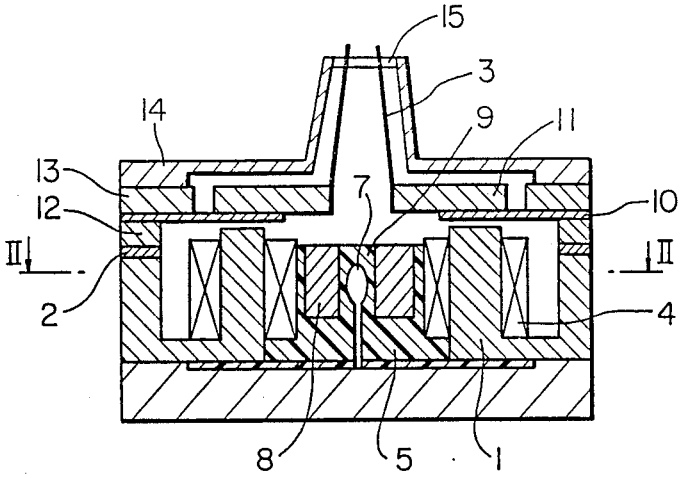
FIG. 1 is a cross-sectional view of a dot matrix print head according to the present invention.
Figure 2:
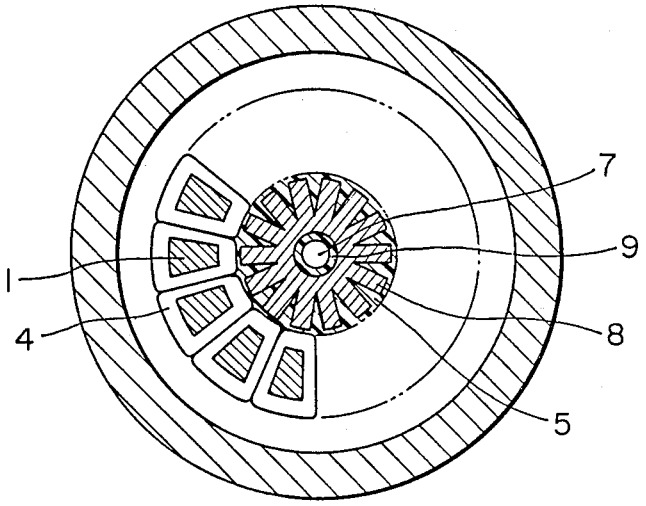
FIG. 2 is a cross-sectional view taken along line II—II of FIG. 1.

As shown in FIGS. 1 and 2, a dot matrix print head according to the present invention includes a plurality of cores 1 forming a magnetic path for a magnetic flux produced by a permanent magnet 2. The cores 1 are angularly spaced at equal intervals in the circumferential direction. There are as many cores 1 as the number of dot pins 3 projecting away from the cores 1 for forming dots. The dot pins 3 are fixed at their bases to radially inner ends of armatures 11 of respective of the cores 1. The armatures 11 are respectively mounted on inwardly projecting arms 10 of resilient disk. The cores 1 are surrounded by respective demagnetizing or driver coils 4.

A heat conductor body 5 of a stepped configuration supports the inner portions of the coils 4, the heat conductor body 5 being made of synthetic resin. A radial member 8 is mounted in the heat conductor body 5. The radial member 8 is made of a material having a small thermal resistance and thermal capacity. The radial member 8 has a substantially central hole 9 accommodating therein a temperature sensor 7 in intimate contact therewith. The temperature sensor 7 may for example be a thermistor having a negative temperature coefficient. The radial member 8 has a plurality of heat conducting arms projecting radially outwardly from the substantially central hole 9 and angularly spaced at equal distances in the circumferential direction. There are as many heat conducting arms as the number of the dot pins 3. The heat conducting arms of the radial member 8 have radially outer ends held in intimate contact with the radially inner surfaces of respective of the coils 4.

A magnetic yoke 12 of ring shape is mounted on the permanent magnet 2. The projecting arms 10 are held by the magnetic yoke 12 and an armature yoke 13 of ring shape. The pins 3 are guided by a pin guide 15 fixed to a hollow projection centrally mounted on a guide frame 14.

The dot matrix print head thus constructed operates as follows:

When a current is passed through the coil 4 associated with a dot pin 3 which should be actuated to print a dot, the coil 4 produces a demagnetizing flux to release the corresponding armature 11 which has been attracted by the magnetic flux from the permanent magnet 2. The armature 11 is displaced away from the core 1 to enable the dot pin 3 fixed to the armature 11 to project out to thereby print a dot.

By cutting off the current that has passed through the coil 4, the armature 11 is magnetically attracted to the core 1 by the permanent magnet 2 to retract the dot pin 3 to its original position.

When a current flows not so often through any desired coil 4, the temperature of the coil 4 lies within an allowable range. However, when a current flows highly frequently through the coil 4, the temperature of the coil 4 exceeds the allowable range. At this time, the heat of the coil 4 is conducted through the corresponding heat conducting arm of the radial member 8 which is held in intimate contact with the inner surface of the coil 4 to the temperature sensor 7.

Since the thermal resistance and thermal capacity of the radial member 8 are small, the temperature sensor 7 can produce an output signal representing the temperature of the coil 4 substantially at the same time that the heat is given off by the coil 4. The output signal from the temperature sensor 7 is delivered to a control unit for stopping or slowing down the printing operation of the dot matrix print head so that the temperature thereof will be lowered.

Inasmuch as the radial outer ends of the heat conducting arms are closely held against the inner surfaces of respective of the coils 4, the temperature sensor 7 can quickly and accurately generate an output signal no matter which coil 4 may be heated.

FIG. 3 shows a temperature curve of a driver coil, a temperature curve of a temperature sensor thermistor in the dot matrix head according to the present invention, and a temperature curve of a temperature sensor thermistor in a conventional dot matrix print head, all plotted against time. The temperature curve of the temperature sensor thermistor in the conventional dot matrix print head is widely spaced from the temperature curve of the driver coil. In the conventional dot matrix print head, therefore, when the thermistor detects a preset temperature $T_1$, the temperature of the driver coil has already exceeded a limit temperature $T_2$ and reached a higher temperature $T_3$. According to the present invention, the temperature curve of the temperature sensor thermistor is closer to the temperature curve of the driver coil, so that the difference between the thermistor temperature and the driver coil temperature is smaller. The driver coil temperature does not reach the limit temperature $T_2$ by the time the thermistor detects the preset temperature $T_1$.

With the arrangement of the invention, the temperature sensor 7 can quickly and accurately produce an output signal representative of the temperature of any of the coils 4. Therefore, the dot matrix print head can be controlled quickly in response to an increase in the temperature of the coils 4, so that the coils 4 are prevented from burnout and the service life of the dot matrix print head is prevented from being reduced by an unwanted temperature rise.

Although a certain preferred embodiment has been shown and described, it should be understood that many changes and modifications may be made thereto without departing from the scope of the appended claims.

What is claimed is:

1. A dot matrix print head comprising:

a permanent magnet;

a plurality of angularly spaced cores combined with said permanent magnet in forming a magnetic path;

a plurality of selectively energizable coils disposed respectively around said cores;

a plurality of angularly spaced dot pins normally attracted magnetically toward said cores by said permanent magnet and selectively actuatable in response to selective energization of said coils;

a heat conductor body supporting said coils;

a radial member mounted in said heat conductor body and having a substantially central hole and a plurality of heat conducting arms projecting radially outwardly from said substantially central hole and having radially outer ends held in intimate contact with respective radially inner surfaces of said coils; and a temperature sensor accommodated in said substantially central hole of the radial member.

2. A dot matrix print head according to claim 1, wherein said heat conducting arms are angularly spaced at equal intervals in a circumferential direction.

* * * * *